US006801172B1

(12) United States Patent
Schwengler

(10) Patent No.: US 6,801,172 B1
(45) Date of Patent: Oct. 5, 2004

(54) OPTICAL-RF MIXED ANTENNA

(75) Inventor: Thomas Schwengler, Lakewood, CO (US)

(73) Assignee: Qwest Communications International, Inc., Denver, CO (US)

( * ) Notice: Subject to any disclaimer, the term of this patent is extended or adjusted under 35 U.S.C. 154(b) by 45 days.

(21) Appl. No.: 10/057,824

(22) Filed: Jan. 25, 2002

(51) Int. Cl.[7] ..... H01Q 19/14
(52) U.S. Cl. ..... 343/781 GA; 343/781 P; 343/781 R
(58) Field of Search ..... 343/781 GA, 781 R, 343/781 P, 840, 725, 782

(56) References Cited

U.S. PATENT DOCUMENTS 4,477,814 A * 10/1984 Brumbaugh et al. ..... 343/725
4,636,797 A * 1/1987 Saffold et al. ..... 343/725
4,866,454 A * 9/1989 Droessler et al. ..... 343/725
5,214,438 A * 5/1993 Brusgard et al. ..... 343/725
6,445,351 B1 * 9/2002 Baker et al. ..... 343/725

* cited by examiner

*Primary Examiner*—Hoanganh Le
(74) *Attorney, Agent, or Firm*—Brian N. Young; Townsend and Townsend and Crew, LLP

(57) ABSTRACT

A first reflecting device is provided that reflects electromagnetic and optical signals to a common focus point. An electromagnetic receiver is positioned at the focus point to receive the reflected electromagnetic signals. The electromagnetic receiver also includes a second reflecting device, which is used for reflecting optical signals. The reflected optical signals are then received by an optical receiver.

25 Claims, 4 Drawing Sheets

OPTICAL-RF MIXED ANTENNA

BACKGROUND OF THE INVENTION

The present invention generally relates to broadband communications and more specifically to a system for receiving and transmitting optical and electromagnetic signals.

With the advent of the internetwork of networks generally referred to as the Internet, more and more users desire broadband access from their homes or offices. With the increasing popularity of the Internet, numerous applications have been developed and an amazing amount of content has been produced for the Internet. As the complexity of the content and applications accessed on the Internet increases, users increasingly desire high speed access to the Internet, such as broadband access. While some solutions, such as Digital Subscriber Lines (DSL) and cable modems, have enabled users to experience broadband service, DSL service and cable modem service do not reach every possible user who desires broadband access. A reason for this is that wireline networks are not able to offer DSL or cable modem services or it is too cost prohibitive to wire a house for the services.

Another way of providing broadband service is through a wireless link. Radio frequency (RF) and microwave frequencies allow a broadband service provider to transmit signals to a user at high data rates such as OC-3. Additionally, infrared (IF) signals allow the broadband service provider to transmit data at speeds up to 10 gigabits. However, IF and RF systems are typically separate and one or the other system is used because it is costly to set up both IR and RF systems. Thus, carriers are reluctant to offer broadband service with both RF and IF systems because of the prohibitive costs.

Wireless broadband access is not without its problems. For example, IF signals are attenuated by fog and RF signals do not transmit well through heavy rains. Thus, wireless communications may be interrupted by the unpredictability of the weather. However, some broadband users receiving wireless broadband service require uninterrupted service and must receive access regardless of the weather. However, even though users require uninterrupted service, providers may be reluctant to offer a user an RF and IF system to ensure that services are uninterrupted because of the prohibitive cost of installing both IF and RF systems.

BRIEF SUMMARY OF THE INVENTION

Embodiments of the present invention use a combination of common properties of electromagnetic wave propagation from low RF frequencies to high optical frequencies in addition to using some of their particularities to differentiate between signals. Thus, a system to transmit and receive signal at two different frequency ranges is provided.

In one embodiment, a first reflecting device is provided that reflects electromagnetic and optical signals to a common focus point. An electromagnetic receiver is positioned at the focus point to receive the reflected electromagnetic signals. The electromagnetic receiver also includes a second reflecting device, which is used for reflecting optical signals. The reflected optical signals are then received by an optical receiver.

In one embodiment, a system for receiving electromagnetic and optical signals is provided The system comprises: a first reflecting device for reflecting the electromagnetic and optical signals; an electromagnetic receiver for receiving the reflected electromagnetic waves, wherein the electromagnetic receiver comprises a second reflecting device for reflecting the optical signals; and an optical receiver for receiving the optical signals reflected from the electromagnetic receiver.

A further understanding of the nature and advantages of the invention herein may be realized by reference of the remaining portions in the specifications and the attached drawings.

DETAILED DESCRIPTION OF THE INVENTION

Figure 1:
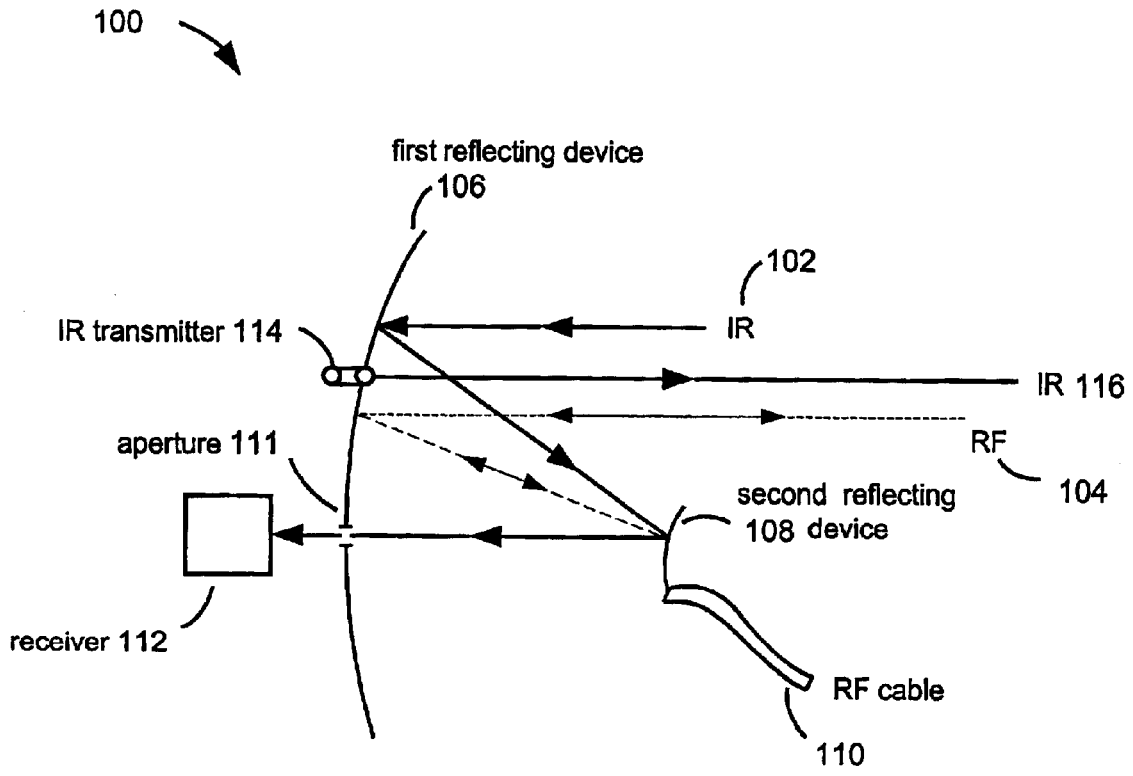
FIG. 1 illustrates a system for transmitting and receiving electromagnetic waves and optical rays according to one embodiment.

FIG. 1 illustrates a system 100 for transmitting and receiving electromagnetic waves and optical rays according to one embodiment. As shown, an embodiment of system 100 for receiving an infrared (IR) signal 102 and a Radio Frequency (RF) signal 104 includes a reflecting device 106, a RF receiver 108, a RF cable 110, and an optical receiver 112.

IR 102 may be any optical ray emitted from an optical source. For example, IR 102 may be an infrared ray emitted from a laser or laser emitting diode (LED).

RF 104 may be any electromagnetic wave emitted from an electromagnetic source. For example, RF 104 is a radio frequency wave or microwave signal. Although IR 102 and RF 104 are used to describe an embodiment of the invention, a person skilled in the art will appreciate other signals that may be used.

First reflecting device 106 may be any device capable of reflecting IR 102 and RF 104 signals towards the same focus point. For example, first reflecting device 106 is a parabolic dish that reflects both IR 102 and RF 104 towards the same focus point of the parabola. In one embodiment, the parabolic dish is made from a metallic material, such as aluminum or copper, that reflects RF 104. Additionally, device 106 is designed to reflect IR 102 signals. Device 106 may include, for example, a mirror coating on the surface or the material that reflects RF 104 may be smoothly polished where IR 102 signals are reflected. Thus, the metallic part of device 106 reflects RF 104, and the smooth polishing of the surface, or an added mirror coating on the surface reflects light and thus IR 102. Because of the parabolic shape of the dish, optical rays and electromagnetic waves are focused into a focus area. Thus, for example, second reflecting device 108 is positioned at focus area so that IR 102 and RF 104 signals are reflected from first reflecting device 106 into second reflecting device 108.

Figure 2:
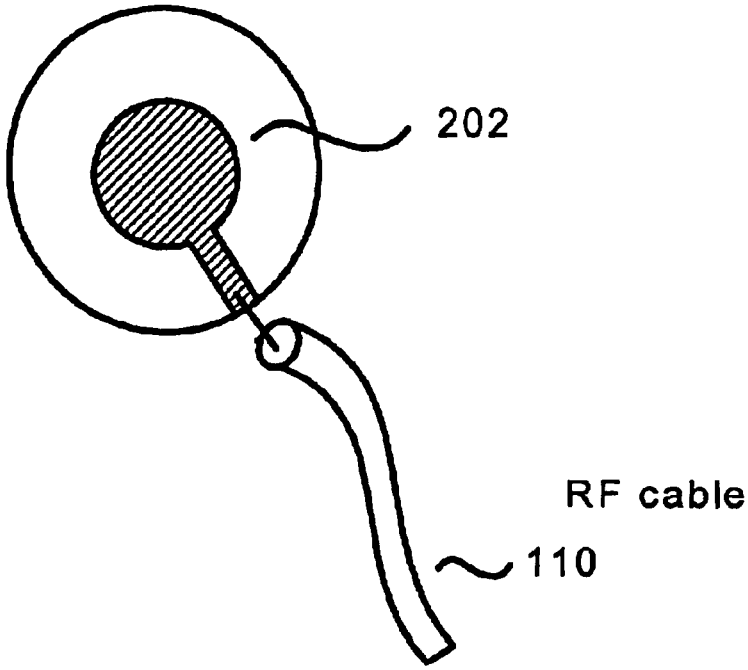
FIG. 2 illustrates an embodiment of a second reflecting device 108.

Second reflecting device 108 maybe any device capable of receiving RF signal 104 and reflecting IR signal 102. One embodiment of the second reflecting device 108 is illustrated in FIG. 2. As shown, second reflecting device 108 includes a RF patch antenna 202 and RF cable 110 in one embodiment.

In one embodiment, patch antenna 202 is capable of receiving RF signals 104. Additionally, patch antenna 202 is capable of reflecting IR signals 102. Thus, patch antenna 202 may be a RF receiver designed to reflect light. For example, patch antenna 202 may be coated with a reflective material as described above with first reflecting device 106 to reflect IR signals 102.

Patch antenna 202 receives RF signal 104 and sends the signal to RF cable 110 or a coax cable. Additionally, IR signal 102 is reflected by patch 202 to a second focus area. In one embodiment, the focus area is opposite patch antenna 202.

Referring back to FIG. 1, first reflecting device 106 may include an aperture 111 where a signal may be reflected through from second reflecting device 108. Thus, reflected IR signals 102 from second reflecting device 108 travel through aperture 111 and are received in receiver 112. Although reflected IR signal 102 is described as being reflected through aperture 111, it will be understood that reflecting signal IR 102 may be reflected through any path to receiver 112 and may not be reflected through an aperture in first reflecting device 106.

Receiver 112 may be any receiver capable of recapturing IR signal 102. For example, receiver 112 is an optical receiver capable of decoding any optical signal such as an infrared signal.

System 100 thus enables the use of one device as an antenna that may be used to capture both IR 102 and RF 104 signals. Both IR 102 and RF 104 are transmitted from a source or sources and are reflected off of first reflecting device 106. First reflecting device 106 reflects IR 102 and RF 104 signals to a focus area where second reflecting device 108 is located. Second reflecting device 108 then captures RF signal 104 and feeds the signal into RF cable 110. Additionally, second reflecting device 108 reflects IR signal 102 to a focus area where receiver 112 is located. In one embodiment, reflected IR signal 102 is reflected through aperture 111 to receiver 112.

In another embodiment, system 100 may be used to transmit IR signal 102 and RF signal 104. In this embodiment, RF signal 104 is emitted from RF cable 110 and second reflecting device 108 out through the path taken by incoming RF signal 104. Thus, the outgoing RF signal is emitted from second reflecting device 108 and reflected by first reflecting device 106 and sent to a receiver, such as system 100. Additionally, an infrared transmitter 114 may be installed on first reflecting device 106 or be independent of first reflecting device 106. IR transmitter 114 transits an IR signal 116 from first reflecting device 106 towards a receiver, such as another system 100.

Thus, a cost effective IR and RF transmitter and receiver may be built using a single system. Accordingly, when conditions are adverse for IR signals, RF signals may be used and vice versa.

Figure 3:
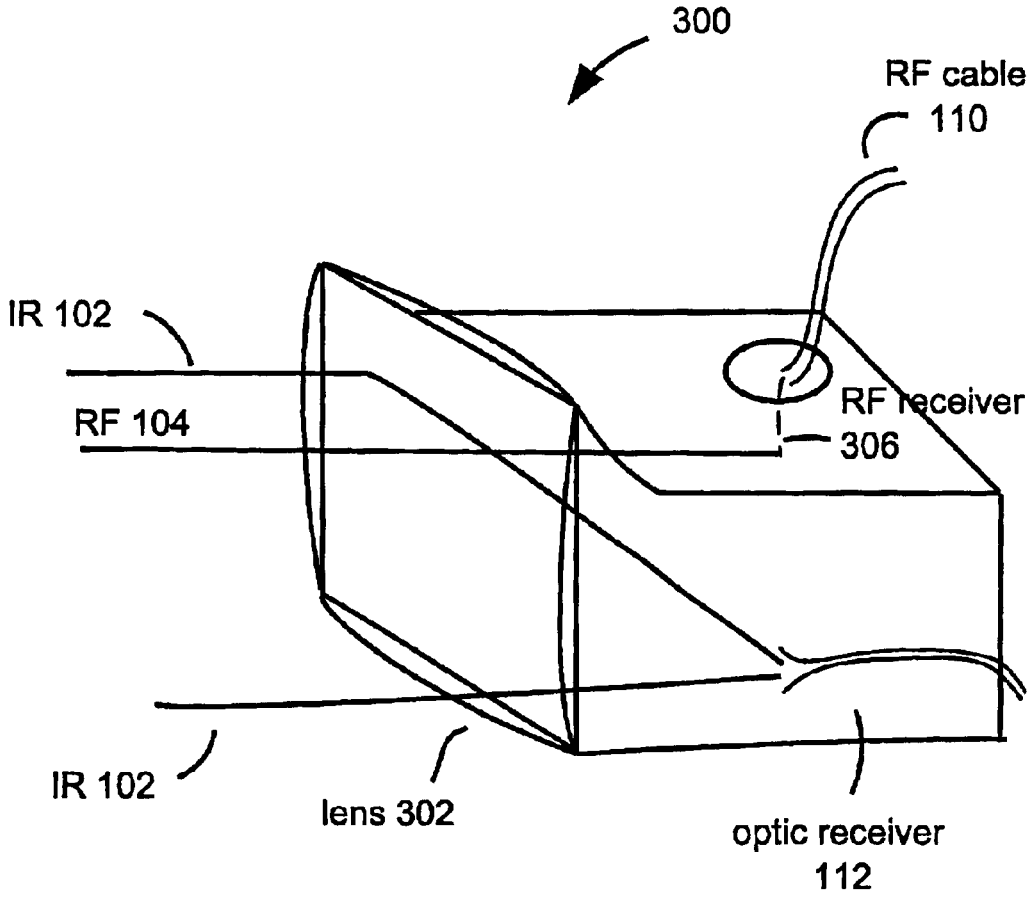
FIG. 3 illustrates an alternative embodiment of a system for transmitting or receiving electromagnetic and optical signals.

FIG. 3 illustrates an alternative embodiment of a system for transmitting or receiving electromagnetic and optical signals. As shown, receiver 300 includes a receiving system for receiving IR signal 102 and RF signal 104 including a lens 302, optical receiver 112, a RF receiver 306, and a RF cable 110.

Receiver 300 may be any device capable of collecting RF signals 104. For example, receiver 300 is a horn shaped as a box-type structure with an open end flared in an outward manner as shown in FIG. 3. By flaring the end in an outward manner, RF signals 104 are collected in RF receiver 306 through the flared end. The flared end obey usual design criteria known in the art of horn antenna design where a larger aperture provides a higher effective area for the antenna, thus higher gain, and tapers the signal to the appropriate dimension of the wave guide required at the frequency of operation. Although receiver 300 is described as having a boxed shape and a flared end, a person of skill in the art will appreciate other ways of implementing receiver 300. For example, rectangular, circular, ellipsoidal horns and wave guides may be used.

RF receiver 306 may be any receiver capable of receiving RF signals 104 and sending RF signals to RF cable 308. For example, RF receiver 306 is RF receiver 200. However, RF receiver 306 may not include a reflective material as described above. Additionally, RF receiver 306 may be an antenna located in receiver 300 for collecting RF signals 104.

In one embodiment, lens 302 is designed to diffract IR signal 102 and allow RF signal 104 to pass through without diffraction. In one embodiment, lens 302 is designed as a convergent lens, oriented and focused in such a way that light rays and thus IR signal 102 focus onto a specific focal point of the lens. Lens 102 is made out of glass, and will be transparent to RF frequencies, therefore leaving RF 104 signals unaffected, as in a standard horn receiver. Some RF perturbation might be expected due to the presence of the lens, but the perturbation should be minimal. Additionally, lens 302 may include similar features as first reflecting device 106 and/or second reflecting device 108. Thus, RF signal 104 is collected in receiver 300 by RF receiver 306 without being diffracted by lens 302. Additionally, IR signal 102 is diffracted by lens 302 to a focus area where optic receiver 304 is located. IR signal 102 is then collected by receiver 304.

In one embodiment, receiver 300 may include a transmitter for trasmitting electromagnetic waves and optical rays. For example, electromagnetic waves may be emitted through RF cable 308 and RF receiver 306 through lens 302. Additionally, an optic transmitter may be included on the outside of receiver 300 or inside of receiver 300 for emitting an optical signal.

Figure 4:
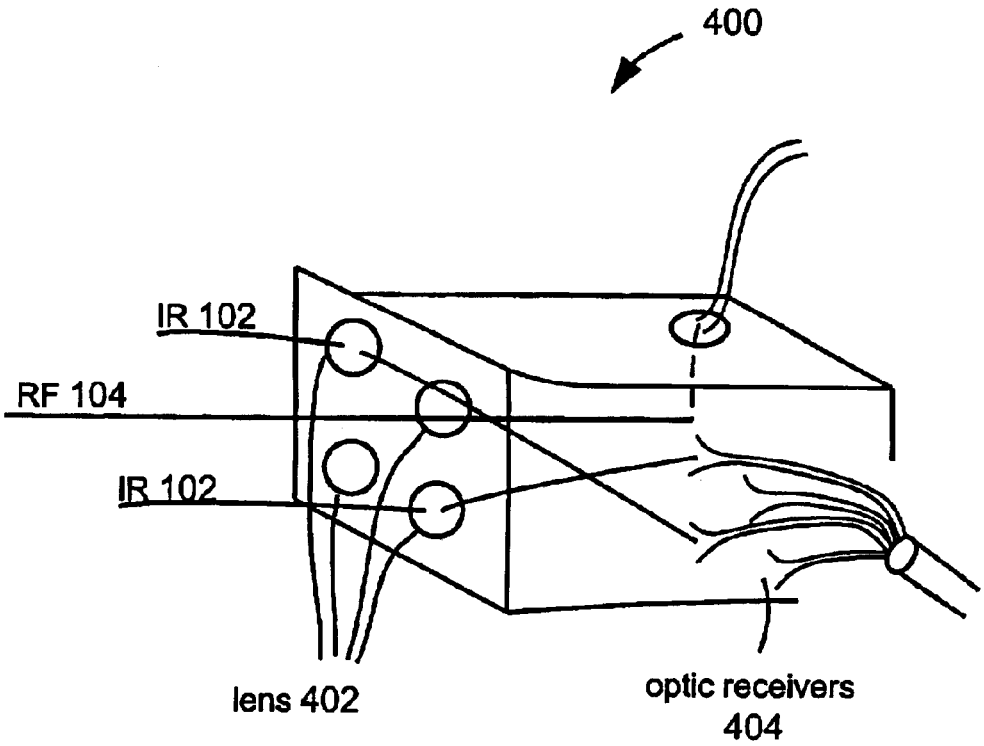
FIG. 4 illustrates an alternative embodiment of a receiver.

FIG. 4 illustrates an alternate embodiment of receiver 300 of FIG. 3. Horn 400 is similar to receiver 300 of FIG. 3; however, horn 400 also includes a plurality of lenses 402 and a plurality of optic receivers 404 in one embodiment.

In one embodiment, lenses 402 are similar to lens 302. However, horn 400 includes multiple lenses that may diffract multiple IR signals 102. Each lens diffracts an IR signal to a focus area Thus, multiple optic receivers 404 are included in multiple focus areas to collect diffracted IR signals from each lens.

The above description is illustrative but not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

What is claimed is:

1. A system for receiving electromagnetic and optical signals comprising:

a first reflecting device for reflecting the electromagnetic and optical signals;

a second reflecting device having a surface for reflecting the optical signals, the surface including a receiver for receiving the reflected electromagnetic waves, wherein the electromagnetic waves are received using the surface that reflects the optical signals; and an optical receiver for receiving the optical signals reflected from the electromagnetic receiver.

2. The system of claim 1, wherein the first reflecting device comprises a parabolic dish.

3. The system of claim 1, wherein the first reflecting device comprises a material to reflect the optical signals.

4. The system of claim 3, wherein the material comprises a mirror-like material.

5. The system of claim 1, wherein the first reflecting device comprises a material to reflect the electromagnetic signals.

6. The system of claim 5, wherein the material comprises a metallic material.

7. The system of claim 6, wherein the metallic material is polished to reflect optical signals.

8. The system of claim 1, wherein the optical signals comprise infrared signals.

9. The system of claim 1, wherein the electromagnetic signals comprise radio frequency signals.

10. The system of claim 1, wherein the electromagnetic signals comprise microwave signals.

11. The system of claim 1, wherein the receiver comprises a material capable of reflecting optical signals.

12. The system of claim 11, wherein the material comprises a mirror-like substance.

13. The system of claim 1, wherein the first reflecting device reflects the electromagnetic and optical rays to a focus area, wherein the focus area includes the electromagnetic receiver.

14. The system of claim 1, further comprising a transmitting system comprising an optical transmitter.

15. The system of claim 1, wherein the electromagnetic receiver is designed to transmit electromagnetic signals.

16. The system of claim 1, further comprising a cable coupled to the receiver configured to collect the received electromagnetic waves.

17. The system of claim 16, wherein the cable is coupled to the surface of the second reflecting device that reflects the optical signals.

18. The system of claim 1, wherein the second reflecting device comprises a patch antenna.

19. A broadband communications system for receiving electromagnetic and optical signals comprising:

a parabolic dish for reflecting the electromagnetic and optical signals to a focus area, the parabolic dish comprising an aperture;

a second reflecting device located in the focus are a, the second reflecting device including a surface for reflecting the optical signals through the aperture the surface including a receiver for receiving the reflected electromagnetic waves, wherein the electromagnetic waves are received using the surface that reflects the optical signals; and an optical receiver for receiving the optical signals reflected through the aperture from the electromagnetic receiver.

20. The system of claim 19, wherein the optical signals comprise infrared signals.

21. The system of claim 19, wherein the electromagnetic signals comprise radio frequency signals.

22. The system of claim 19, wherein the electromagnetic signals comprise microwave signals.

23. The system of claim 19, further comprising a cable coupled to the electromagnetic receiver configured to collect the received electromagnetic waves.

24. The system of claim 23, wherein the cable is coupled to the surface of the second reflecting device that reflects the optical signals.

25. The system of claim 19, wherein the second reflecting device comprises a patch antenna.

* * * * *